United States Patent [19]

Paletta et al.

[11] 3,934,284

[45] Jan. 27, 1976

[54] STEREO HEAD BOARD

[76] Inventors: John R. Paletta; Helen Paletta, both of 14522 Seneca Trail, Middleburg, Ohio 44130

[22] Filed: Mar. 1, 1974

[21] Appl. No.: 447,066

[52] U.S. Cl. ..... 5/280; 5/317 R; D6/83

[51] Int. Cl.[2] ..... A47C 20/00

[58] Field of Search..... D6/83; 135/8; 5/53 R, 53 B, 5/53 D, 280, 281, 10 R, 285, 317 R; 297/391; 312/226, 223; 248/489; 350/299

[56] References Cited

UNITED STATES PATENTS

| | | | |
|---|---|---|---|
| 1,440,906 | 1/1923 | Bouza | 5/317 R |
| 2,075,319 | 3/1937 | Wilkie | 5/280 |
| 3,156,500 | 11/1964 | Kerr | 297/391 |
| 3,736,603 | 6/1973 | Rothman | 5/280 |

FOREIGN PATENTS OR APPLICATIONS

| | | | |
|---|---|---|---|
| 666,829 | 11/1950 | United Kingdom | 5/317 R |
| 651,201 | 2/1929 | France | 248/489 |
| 20,521 | 9/1902 | United Kingdom | 312/223 |

*Primary Examiner*—Paul R. Gilliam
*Assistant Examiner*—Kenneth J. Dorner

[57] ABSTRACT

This device consists primarily of a pair of circular members which are chain suspended, each having a speaker and a mirror secured therein, the units being connected together by means of plate and screws.

1 Claim, 3 Drawing Figures

STEREO HEAD BOARD

This invention relates to stereo sound systems, and more particularly to a stereo head board.

It is therefore the principal objects of this invention to provide a stereo head board which will be suspended from the ceiling at the head of a bed.

Another object of this invention is to provide a stereo head board which will be adaptable for use over a triple dresser.

A further object of this invention is to provide a device of the type described, which will include a pair of mirrors within.

Other objects of the invention are to provide a stereo heard board which is simple in design, inexpensive to manufacture, rugged in construction, easy to use and efficient in operation.

These and other objects will be readily evident upon a study of the following specification and the accompanying drawing, wherein.

Figure 1:
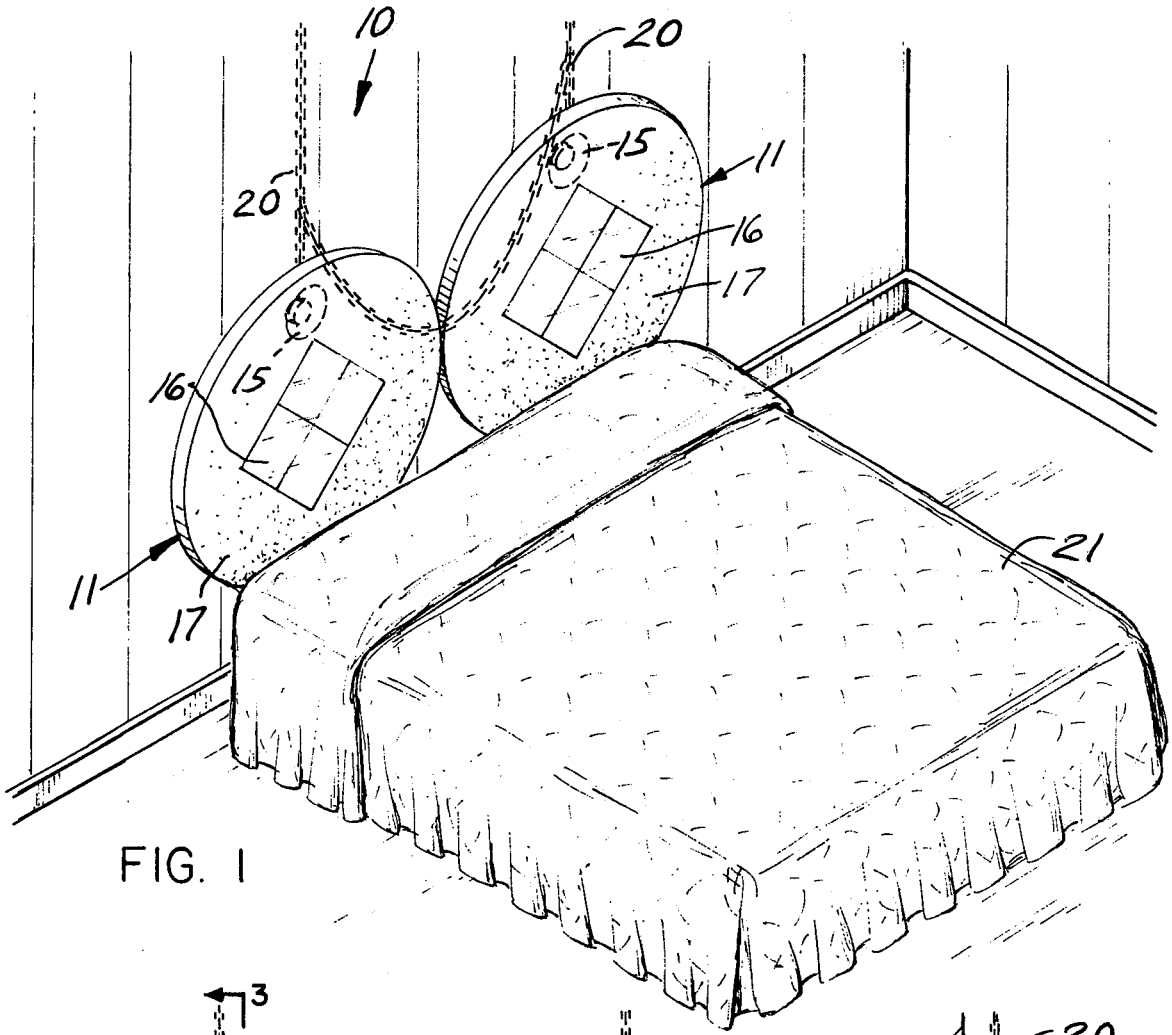
FIG. 1 is a perspective view of the head board shown in use.
Figure 2:
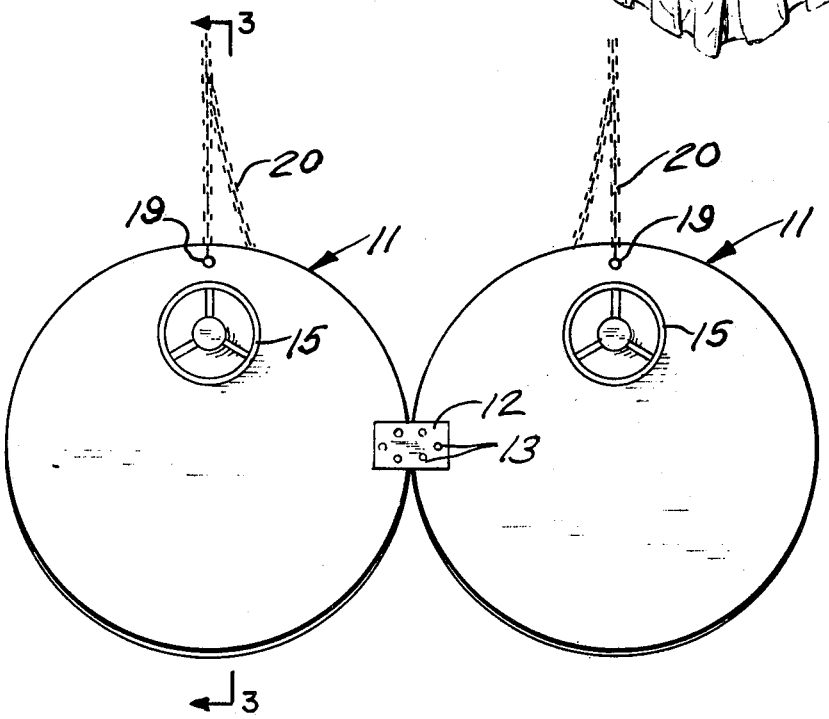
FIG. 2 is a rear view of the device shown in elevation.
Figure 3:
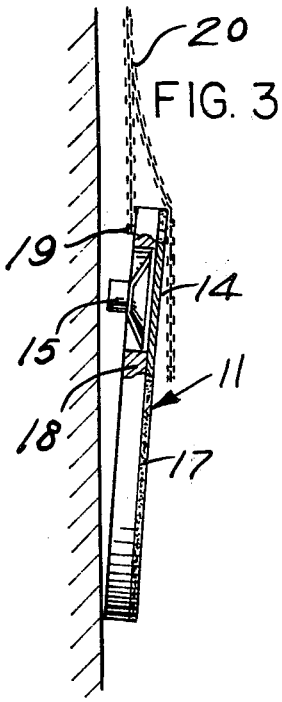
FIG. 3 is a cross sectional view taken along the line 3—3 of FIG. 2.

According to this invention, a stereo head board 10 is shown to include a pair of circular members 11 which are fastened to each other by means of a rectangular plate 12 with fasteners 13. The circular members 11 include plywood 14 to which is fastened, each, a speaker 15 near the upper extermities of members 11. A mirror 16 is secured to each of the circular members 11 in a suitable manner and is suitable material 17 provides facing for the circular members 11 around the mirror 16 and in front of the speakers 15. The circular members 11 are backed with foam rubber 18 and a hook 19 secured fixedly to each of the members 11, is secured to chains 20 which depend from hook (not shown) in ceiling.

What I now claim is:

1. A headboard in combination with speakers and mirrors mounted on said headboard, and means to suspend said headboard, said headboard comprising a pair of circular panels, said panels being secured together at their peripheries by a single flat plate fastened to one side of both of said panels, each of said panels having a speaker and a mirror mounted thereon, said means to suspend comprising chains suspended from a ceiling, connected to each of said panels, whereby said headboard may be suspended from a ceiling at the head of said bed.

* * * * *